US007137435B2

(12) United States Patent
Fujikawa

(10) Patent No.: US 7,137,435 B2
(45) **Date of Patent: *Nov. 21, 2006**

(54) ENHANCED COLD CHAMBER DIE CASTING MOLDING MACHINE

(75) Inventor: Misao Fujikawa, Kaga (JP)

(73) Assignee: Sodick Plustech Co., Ltd., Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/535,478

(22) PCT Filed: Nov. 17, 2003

(86) PCT No.: PCT/JP03/14690

§ 371 (c)(1),
(2), (4) Date: May 17, 2005

(87) PCT Pub. No.: WO2004/045791

PCT Pub. Date: Jun. 3, 2004

(65) Prior Publication Data

US 2006/0042772 A1 Mar. 2, 2006

(51) Int. Cl.
*B22D 17/10* (2006.01)
*B22D 39/00* (2006.01)

(52) U.S. Cl. ..... 164/312; 164/136; 164/900

(58) Field of Classification Search ..... 164/113, 164/312, 900, 133–136, 335–337
See application file for complete search history.

(56) References Cited

U.S. PATENT DOCUMENTS 4,356,940 A 11/1982 Ansorge
4,534,403 A 8/1985 Harvill
4,591,476 A 5/1986 Greenwood et al.
5,244,033 A * 9/1993 Ueno ..... 164/312
5,983,976 A 11/1999 Kono
6,059,012 A * 5/2000 Vining et al. ..... 164/312

(Continued)

FOREIGN PATENT DOCUMENTS

EP 1 275 451 A2 3/1997

(Continued)

OTHER PUBLICATIONS

International Search Report dated Dec. 2, 2003.

*Primary Examiner*—Kuang Y. Lin
(74) *Attorney, Agent, or Firm*—McDermott Will & Emery LLP.

(57) ABSTRACT

An injection apparatus in a cold chamber die casting molding machine, where a melting device of the injection apparatus includes a billet supplying device for replenishing a light metal material in the form of a billet, a melting cylinder for melting the billet from its front end and forming a molten metal for several shots, an inserting device for inserting a billet into the melting cylinder, and a plunger injection device. The amount of a molten metal for one shot is measured via an opening and shutting device of a molten metal feeding member and is fed from the melting device to the plunger injection device. In particular, the sealing of the molten metal in the melting cylinder is achieved by the contact of the side surface of a portion of the billet having an enlarged diameter with the hole of the cylinder, or by the contact of a circular solidified material formed in a circular groove in a cooling sleeve with the billet. The injection apparatus can be used for feeding and melting a light metal materiel such as a magnesium alloy material with better efficiency and measuring the amount of a molten metal with higher accuracy.

1 Claim, 5 Drawing Sheets

U.S. PATENT DOCUMENTS

| | | | | |
|---|---|---|---|---|
| 6,152,159 | A | 11/2000 | Miller et al. | |
| 6,923,244 | B1 * | 8/2005 | Motegi et al. | 164/316 |
| 2003/0000676 | A1 | 1/2003 | Motegi et al. | |

FOREIGN PATENT DOCUMENTS

| | | |
|---|---|---|
| EP | 0 761 344 A2 | 1/2003 |
| JP | 48-49211 | 6/1973 |
| JP | 60-9563 | 1/1985 |
| JP | H05-212531 | 8/1993 |
| JP | H05-254858 | 10/1993 |
| JP | 09-103859 | 4/1997 |
| JP | 09-108805 | 4/1997 |
| JP | 2639552 | 5/1997 |
| JP | 10-296417 | 11/1998 |
| JP | 2000-254764 | 9/2000 |
| JP | 2001-191168 | 7/2001 |
| JP | 3258617 | 12/2001 |
| JP | 2002-301559 | 10/2002 |
| JP | 2003-19552 | 1/2003 |
| JP | 05-238765 | 9/2003 |
| JP | 2004-50269 | 2/2004 |

* cited by examiner

ENHANCED COLD CHAMBER DIE CASTING MOLDING MACHINE

FIELD OF THE INVENTION

The present invention generally relates to an injection apparatus for a cold chamber die casting molding machine and, more specifically, relates to an injection apparatus which replenishes a light metal material into its melting device in the form of a short cylindrical rod billet, and supplies the molten metal into a plunger injection device. Moreover, the present invention relates to a measuring method for the cold chamber die casting molding machine.

DESCRIPTION OF THE RELATED ART

Injection molding machine for light metal alloys, such as magnesium, aluminum or zinc, are generally known as die casting molding machines, and are categorized as either a "hot chamber method" machine or a "cold chamber method" machine. The hot chamber machine, which positions an injection device on a furnace, measures one shot of the molten metal in an injection sleeve of the injection device by sucking the molten metal from the furnace, and injects it into a mold cavity with a plunger. With the hot chamber method machine, high temperature molten metal is stably supplied into the injection sleeve.

Alternatively, the cold chamber method machine, which positions an injection sleeve outside of a furnace, measures the molten metal by transferring it from the furnace to the injection sleeve with a pump or ladle, and injects it with a plunger. With the cold chamber method machine, maintenance is easier, since the injection device is separated from the furnace.

The above-described conventional molding method machine have a high operating cost, since the size of the furnace is much larger than that of the molded articles, and since a great volume of molten metal needs to be kept at a specified high temperature. Additionally, it takes a long time to raise or lower the furnace temperature, and maintenance work may render a furnace inoperable for a whole day.

Moreover, and especially in the case of easily oxidized magnesium alloy molding materials, it is necessary to occasionally remove the magnesium oxide sludge. The surface area of the molten metal in the furnace is too large to prevent the generation of the sludge, although much non-burning flux or inert gas is poured into the furnace, and this sludge causes wear of the injection sleeve and the plunger.

Conventional injection apparatus for supplying molding material directly to a plunger injection device without adopting the furnace are generally known in the art, such as injection apparatus having a material supply device capable of supplying light metal material in the form of a short cylindrical rod-shaped billet or ingot. This type of conventional injection apparatus generally injects semi-solidified molding material into the mold, solving the furnace-related problems and decreasing the potential for oxidation of a magnesium alloy.

More specifically, Japanese Patent No. 2639552 provides for an injection apparatus with a heating sleeve which accommodates plural ingots for preliminary heating, an injection sleeve which contains a plunger, and a chute which leads the ingot from the heating sleeve to the injection sleeve. The ingots are formed into the size for one shot of the injection amount beforehand, by other forming apparatus. This injection apparatus transfers the ingots, which have been heated and softened in the heating sleeve, to the injection sleeve. The material, which has been turned into semi-molten state, is injected into the mold with the plunger pressurizing.

Japanese Patent Laid-Open No. 2001-191168 provides another type of injection apparatus with a forming-hole (dice) and a cutter plate at the front end of a heating sleeve, which forms and cuts off the billet to match the injection sleeve, where the billet corresponds to the above described ingot. With this apparatus, the outside diameter of the billet is formed to fit with the inside diameter of the injection sleeve, and the overall length of the billet is cut off so as to become one shot of injection amount. Therefore, the troublesome problems associated with Japanese Patent No. 2639552 are solved, increasing of the variety of the ingots and the related preliminary heating condition settings, making it unnecessary to pre-prepare many kinds of ingots for every molded article.

Japanese Patent Laid-Open No. Rei 05-212531 proposes an alternative injection apparatus with a high temperature cylinder section at mold side (the front side closest to the mold), a low temperature cylinder section at rear side (base side), and a heat insulating cylinder section between them. With this injection apparatus, a pre-formed cylindrical molding material rod is inserted into the above-described injection cylinder, is then melted in the high temperature cylinder section, and finally its molten metal is injected by the not-yet-melted molding material. Since the molding material is injected not by a plunger but rather by the not-yet-melted molding material itself, this molding material is known as a "self-consumption plunger." Since this type of injection apparatus does not need a furnace, it makes the structure of its melting device vicinity simple and also enables efficient melting. Moreover, this injection apparatus does not need a plunger, thus reducing the wear of the injection cylinder and reducing maintenance work time.

Although Japanese Patent Laid-Open No. Rei. 05-254858 provides a similar injection apparatus, this injection apparatus is primarily used for preventing the seizure of forming glass.

The above-described injection apparatus of both the hot chamber method machine and the cold chamber method machine include some furnace-related problems. Also, the injection apparatus described in Japanese Patent No. 2639552 and Japanese Patent Laid-Open No. 2001-191168, which do not contain a furnace, have such a limitation that they are not suitable for molding particularly thin walled and/or precise geometry articles, since they are do not inject fully molten metal. When these types of injection apparatus attempt injection with fully molten molding material, a longer waiting time is required to change the material into a fully molten matter.

Japanese Patent Laid-Open No. Rei. 05-212531, which uses the self-consumption plunger, does not disclose the length of the molding material or its supply method. Moreover, Japanese patent laid-open No. Rei. 05-212531 does not describe the solution to the problem of impeded plunger movement, which often makes injection process impossible. This problem occurs since the molten metal, which has low viscosity and high pressure, flows backward through the gap between the injection sleeve and the self-consumption plunger, and then is solidified, accompanying increased frictional resistance.

Because the injection apparatus functions as an injection apparatus as well as a melting device, the pressure of the molten metal becomes high. In the case where a self-consumption type plunger is installed horizontally in the injection sleeve, the above-described problem becomes more remarkable, since the gap between the plunger and the injection sleeve is larger at its raised side, since the outside diameter of the self-consumption plunger is manufactured somewhat thinner than the inside diameter of the injection sleeve anticipating thermal expansion.

The above-described problem also becomes more pronounced in the case where the solidified matter of the molten metal is destroyed and re-formed at many times of injection molding operation and, as a result, grows up widely and hardly. In particular, in the case of molding for a particularly thin-walled shape and/or a particularly complicated geometry shape, the occurrence of the problem becomes more remarkable, since an injection is carried out under high speed and/or high pressure conditions.

Japanese patent laid-open No. Rei. 05-254858 does not solve the above-described problem either, since it discloses seizure prevention technology for forming glass. Specifically, it describes cooling technology for promoting the cooling of molding material with plural grooves or spiral grooves on the cylinder wall. In the case of forming glass, the operational effect at the grooves is supposed to be effective, since molten glass does not rapidly fill up the grooves because of high viscosity of its softened matter, at comparatively a wide temperature range inherent to glass. However in the case of light metal molding, light metal melts and solidifies rapidly due to small specific heat, small latent heat, and high coefficient of thermal conductivity inherent to light metal.

Furthermore, the temperature range at which light metal is in a softened state is narrower than that of glass, and the molten metal also presents extremely low viscosity fluidity. Therefore the molten metal is rapidly intruded into the grooves and solidifies quickly, and thus the grooves do not function as cooling grooves or as deformation absorption grooves. Accordingly, the conventional injection apparatus are still incomplete with regard to the stable injection of molten light metal.

Accordingly, it is an object of the present invention to provide such an injection apparatus that makes the conventional furnace unnecessary. In particular, it is desirable to make it possible to replenish a light metal material in the form of the billet and to supply said material into an injection device in the form of full molten material, where the injection apparatus can feed and melt a light metal materiel with efficiency and can measure one shot of injection amount of molten metal with accuracy.

SUMMARY OF THE INVENTION

The present invention generally relates to an injection apparatus for a cold chamber die casting molding machine and, more specifically, relates to an injection apparatus which replenishes a light metal material into its melting device in the form of a short cylindrical rod billet, and supplies the molten metal into a plunger injection device. Moreover, the present invention relates to a measuring method for the cold chamber die casting molding machine.

According to a first arrangement, the present invention is an injection apparatus in a cold chamber die casting molding machine which supplies molten metal of a light metal material into a material supply mouth of an injection sleeve, the injecting sleeve having a plunger injection device for injecting the molten metal using an injecting plunger. The injection apparatus includes a melting device for melting the light metal material, and a molten metal feeding member. The melting device further includes a billet supplying device, the billet supplying device replenishing the molding metal using a plurality of cylindrical rod-shaped billets of the light metal material, and a billet inserting device disposed adjacent to the billet supplying device, the billet inserting device moving each billet forward with an inserting plunger and/or retreating the inserting plunger a distance which exceeds an overall length of each billet. The melting device also includes a first melting cylinder situated adjacent to the billet supplying device obverse to the billet inserting device, the first melting cylinder accommodating the plurality of billets moved forward by the inserting plunger and incrementally melting the plurality of billets to produce several shots of molten metal, the melting device measuring the molten metal by pushing each billet with the inserting plunger and supplying one shot of the molten metal into the injection sleeve after the plunger injection device makes the inserting plunger retreat. The molten metal feeding member is for pouring molten metal from the melting device to the plunger injection device, the molten metal feeding member forming a material supplying hole for pouring the molten metal from a distal end of a cylinder bore of the first melting cylinder to the material supply mouth.

The inside diameter of a portion of the cylinder bore distal to the billet inserting device matches the outside diameter of a solid, enlarged, heated billet so as to prevent backward flow of the molten metal, and the inside diameter of a portion of the cylinder bore adjacent to the billet inserting device is slightly larger than the outside diameter of each billet.

The injection apparatus further includes a cooling member, the cooling member cooling each billet and forming a through hole, the diameter of the through hole being larger than the outside diameter of each billet, the cooling member further including a cooling duct around the through hole. The injection apparatus also includes a second melting cylinder, the diameter of at least a portion of a cylinder bore of the second melting cylinder being greater than the diameter of each billet so as to prevent contact between the billet and the cylinder bore. Additionally, the injection apparatus includes a cooling sleeve disposed between the cooling member and the second melting cylinder, the cooling sleeve forming an annular groove, the annular groove cooling the molten metal and generating a annular seal of solidified molten material on the periphery of each billet.

The material supplying hole is in fluid communication with the cylinder bore of the first melting cylinder via a connecting passage, the connecting passage opening at an upper portion of the cylinder bore of said first melting cylinder, and the first melting cylinder is inclined, with a front portion of the first melting cylinder in a high position.

The injection apparatus further includes an opening and shutting device disposed between the melting device and the plunger injection device, the opening and shutting device further including a valve rod for opening and shutting the bottom end of the material supplying hole by going up and down in the material supplying hole, and a valve rod driving device for opening the valve rod when measuring.

The material supplying hole stores the molten metal during measuring, and the inserting plunger and the valve rod operate substantially simultaneously.

By virtue of this type of structure, the melting device of the injection apparatus of this invention replenishes light metal material in the form of the billet of a short cylindrical rod shape, and melts a minimal quantity for supplying the molten metal to the injection sleeve. Therefore, heating and solidifying in the melting cylinder can be done for a short time, and it becomes possible to rapidly finish maintenance work of the injection apparatus. Moreover the heating energy for melting the material in the melting device decreases, making heating efficient. Also, the volumetric size of the melting device is remarkably smaller than that of the conventional furnace. In addition, the handling is easy because the light metal material is supplied in the form of the billet. In case the billet is magnesium material, another advantage is that it is difficult for the billet to oxidize.

The melting cylinder of said injection apparatus in a cold chamber die casting molding machine includes a first melting cylinder such that most of a cylinder bore, except for the base side of the first melting cylinder, is formed to have an inside diameter which keeps most of the cylinder bore in contact with an enlarged side surface of the not-yet-melted front end of said billet to such a degree that the backward flow of the molten metal is prevented. The cylinder bore of the base side of the first melting cylinder is formed to have a slightly larger diameter than an outside diameter of the billet.

With this construction of the injection apparatus, the melting device includes a first melting cylinder such that most of the cylinder bore of the first melting cylinder, excluding the base side, is formed to have an inside diameter which keeps said most of the cylinder bore in contact with the enlarged side surface of front end of billet with the degree which prevents the backward flow of the molten metal at the time of measuring. The cylinder bore of the base side is formed to have such an outside diameter that is a slightly larger than that of the billet. As such, the enlarged side surface prevents the backward leakage of the molten metal and the introduction of air and the like into the molten metal as an enlarged diameter seal member and hence functions as the seal with small frictional resistance.

Since the first melting cylinder and the plunger do not contact each other, they are not quickly worn, minimizing required maintenance work for the melting device. This type of melting cylinder is so simple that it is effective when it is adopted for a small-sized injection molding machine.

The melting device of the injection apparatus contains a cooling sleeve between the second melting cylinder and a cooling member, the cooling member having a hole the inside diameter of which is a slightly larger than the outside diameter of the billet. Most of the cylinder bore of the second melting cylinder is formed to have an inside diameter which does not allow most of the cylinder bore to come into contact with the front end of the billet, and the cooling sleeve has an annular groove which generates an annular seal of solidified matter from said molten metal by cooling it.

Therefore the circular solidified material prevents the backward leakage of the molten metal and the introduction of air and the like into the molten metal as a circular solidified material seal, and also functions as a seal with small frictional resistance. This type of melting cylinder can be effectively adopted by both small and large-sized injection molding machines.

The material supplying hole of the molten metal feeding member of the injection apparatus in a cold chamber die casting molding machine leads to the cylindrical bore of the melting cylinder via a connecting passage. The connecting passage is an opening at the upper portion of the cylinder bore of the melting cylinder and the melting cylinder is arranged in the inclined posture in which the front portion is high position.

The material supplying hole of the molding material feeding member leads through a connecting passage which opens at the upper portion of the cylinder bore of the melting cylinder, and the melting cylinder is arranged in the inclined posture with its front side high. Therefore the air and the gas which remains in the melting cylinder is, at first, promptly purged, and the problem in which molten metal in the melting cylinder unexpectedly overflows into the injection sleeve except for the measuring timing is prevented, ensuring measuring accuracy.

Preferably, an injection apparatus opening and shutting device for cold chamber die casting molding is provided between the melting device and the plunger injection device. The opening and shutting device contains a valve rod for opening and shutting the bottom end of the material supplying hole by moving up and down in the material supplying hole, and a valve rod driving device for opening the valve rod at the time of measuring.

With this type of structure, the valve rod opens the bottom end of the material supplying hole at the time of measuring, preventing the unexpected dropping of the molten metal in the material supplying hole other than the measuring times, assuring accurate measuring.

The measuring method used in the cold chamber die casting molding machine injection apparatus, in which the opening and shutting device opens and shuts the material supplying hole, occurs by measuring the molten metal in such a manner that the molten metal is always stored in the material supplying hole with the opening and shutting operation of the material supplying hole and the extruding operation of the plunger performed almost simultaneously.

In this measuring method, since the opening and shutting operation of the material supplying hole by means of the opening and shutting device and the extruding operation of molten metal by means of the plunger are performed simultaneously, solidification of molten metal in the material supplying hole is prevented. Furthermore, adhesion of molten metal to the material supplying hole or the valve rod is prevented, ensuring accurate measurement control.

In the following description of the preferred embodiment, reference is made to the accompanying drawings that form a part thereof, and in which is shown by way of illustration a specific embodiment in which the invention may be practiced. It is to be understood that other embodiments may be utilized and changes may be made without departing from the scope of the present invention.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

The present invention provide an injection apparatus that obviates the need for a furnace. Specifically, the present invention makes it possible to replenish a light metal material in the form of the billet and to supply said material into an injection device in the form of full molten material, where the injection apparatus can feed and melt a light metal materiel with efficiency and can measure one shot of injection amount of molten metal with accuracy. The injection apparatus in a cold chamber die casting machine according to the present invention is described below, using illustrative embodiments.

Figure 1:
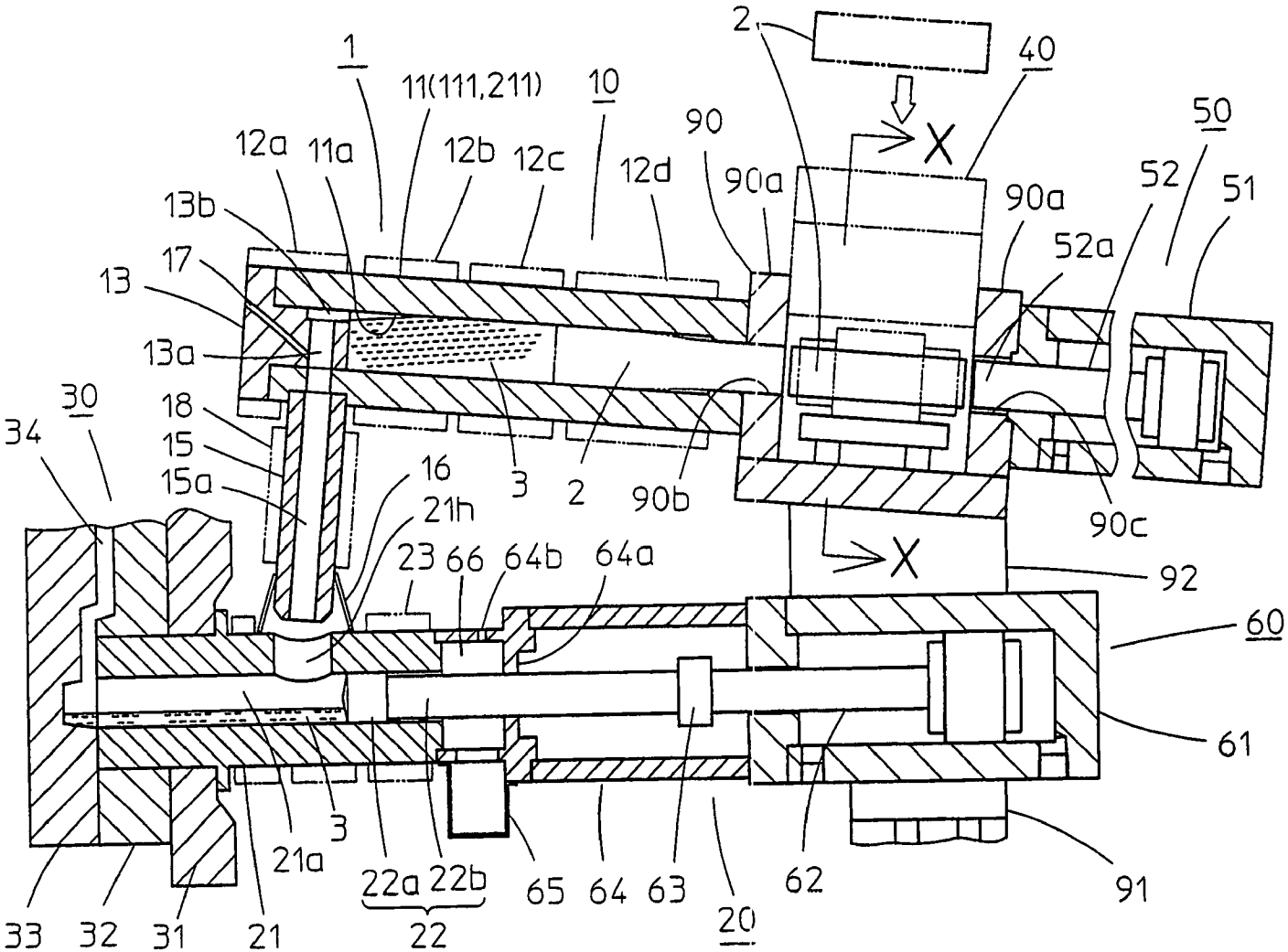
FIG. 1 is a cross-sectional elevation view showing the outline structure of an injection apparatus in a cold chamber die casting molding machine according to one arrangement of the present invention.

Initially, the light metal material which is to be supplied into the injection apparatus is described, below. The light metal material is formed into a shape of a short rod, or "billet", which is pre-cut from a cylindrical bar, to a specified length. Referring to FIG. 1, the periphery surface and cut off end surface of billet 2 are finished smooth. The outside diameter of billet 2 is formed to be 0.2 mm to 0.5 mm thinner than the inside diameter of a base end (right end) side of a cylinder bore 11*a* of a melting cylinder 11 when billet 2 has expanded after heated, as described below.

The length of billet 2 is formed to correspond to the volume of from tens of shots to a several tens of shots of the injection amount and, in one example, is formed to be approximately 300 mm to 400 mm long, to ease its handling. Since the light metal material is supplied in this form of a billet, storage and handling of the materials is easy. In the case where the billets 2 are made of magnesium material, the billets are more difficult to oxidize than the palletized metal which is conventionally used in thyrotrophic molding, since the surface area with respect to the volume is small.

Incidentally, the above-described one shot of injection amount is the sum of the volume of molten metal for one shot injection, which includes the volume of the molded articles and the accompanying volume, such as a spool, runner, and the thermal shrinkage volume.

An outline of several example embodiments of the injection apparatus in a cold chamber die casting molding machine according to the present invention is described, below. As shown in FIG. 1, the injection apparatus 1 includes a melting device 10, a plunger injection device 20, and a molten metal feeding member 15 which pours molten metal from the melting device 10 to the plunger injection device 20.

The melting device 10 is different from the conventional injection apparatus of cold chamber die casting molding machine, since the light metal material is replenished in the form of billets, which are described above. The melting device 10 includes the melting cylinder 11, a billet supplying device 40 and a billet inserting device 50. The melting cylinder 11 and the billet inserting device 50 are fixed to a central frame member 90.

The central frame member 90 is used for mounting the billet supplying device 40 and is composed of four rectangular side plates 90*a* and a single bottom plate. In one of the two opposing plates 90*a*, a through hole 90*b* is formed having a diameter slightly larger than the outside diameter of a billet 2. In the other of opposing plates 90*a*, a through hole 90*c* is formed, in which a plunger 52*a* moves forward and backward, as is described more fully below.

The melting cylinder 11 is a long cylinder formed to have such a length as to accommodate plural billets 2. Most of the cylinder bore 11*a*, except for the vicinity of the base end, is formed to have a larger diameter than that of a billet 2, as is described more fully below. The front end of the cylinder bore 11*a* is blocked by an end plug 13, but the cylinder bore 11*a* leads to a material supplying hole 15*a* in the molten metal feeding member 15, as is described more fully below. With the melting device 10 composed in this way, the billets 2 are replenished one by one to the rear of the melting cylinder 11 by the billet supplying device 40. The billets 2 are inserted into the melting cylinder 11 by the plunger 52*a* of the billet inserting device 50, so as to melt from their front end.

The amount of molten metal 3 is controlled to secure several shots of injection amount, as is described more fully below. The melting cylinder 11, the molten metal feeding member 15, the billet supplying device 40 and the billet inserting device 50 are also described below as well.

The plunger injection device 20 is similar to that of the conventional injection apparatus in a cold chamber die casting molding machine, and includes an injection sleeve 21, a plunger 22 and a plunger driving device 60. The injection sleeve 21 and the plunger driving device 60 are arranged in series on a single line by a connecting member 64.

The injection sleeve 21 has a sleeve bore 21*a* for temporarily storing molten metal 3, and has a material supply mouth 21*h* on the upper portion, through which molten metal 3 is poured. The front (left) end of the injection sleeve 21 goes through a stationary platen 31 and a mold half 32.

The plunger 22 is connected at its base end to a piston rod 62 of the plunger driving device 60, and is subjected to controlled movement in a longitudinal direction within the injection sleeve 21. The plunger injection device 20 supports the melting device 10 via the central frame member 90. The central frame member 90 is affixed on a connecting base member 92 arranged on the plunger driving device 60. The plunger driving device 60 is placed on a slide base 91 of a machine base frame (not depicted).

The plunger injection device 20 fills molten metal 3 into a cavity 34 with the plunger 22. Additional details relating to the injection sleeve 21, the plunger 22, the connecting member 64 and the plunger driving device 60 are described below. Incidentally, the mold halves 32 and 33 comprise a conventional mold unit, where the mold half 32 is fixed on the stationary platen 31 of a clamping device 30, and where the cavity 34 is formed when the mold half 33 is closed.

The material supplying hole 15*a* in the molten metal feeding member 15 is affixed near the front (left) end of the melting cylinder 11 leading to the cylinder bore 11*a* through connecting passages 13*a* and 13*b* in the end plug 13. The lower portion of the molten metal feeding member 15 and the material supply mouth 21*h* are covered with a cover 16. A pouring hole 17 through which inert gas is filled leads to the connecting passage 13*a*, the material supplying hole 15*a* and/or the cover 16. For example in FIG. 1, the pouring hole 17 is formed in the end plug 13, whereas in FIG. 5 the pouring hole 17 is formed on the cover 16, as is described below. Inert gas filled through the pouring hole 17 purges out air in the material supplying hole 15*a* and the injection sleeve 21. This purge prevents the oxidation of the molding material, such as easily-oxidizable magnesium alloys.

On the melting cylinder 11 of the injection apparatus 1, for example, band heaters 12*a*, 12*b*, 12*c* and 12*d*, are wrapped so as to melt the billet 2 from its front end to its back end. Moreover, a heater band 18 and a heater band 23 are wrapped around the molten metal feeding member 15 and the injection sleeve 21 so as to keep molten metal 3 in a molten state.

The aforementioned heater bands control their surroundings to a specified set up temperature based on the feedback temperature from sensors (not depicted). For example, in case a billet 2 is magnesium alloy, the temperature of the heater bands 23 and 18 is set to about 600° C. to 650° C. The setting of temperatures for heater bands 12*a*, 12*b*, 12*c* and 12*d* are described in greater detail, below. Melting cylinder 11 is made of ceramics and or a similar material, so the heater bands can be induction-heating coils.

Figure 2:
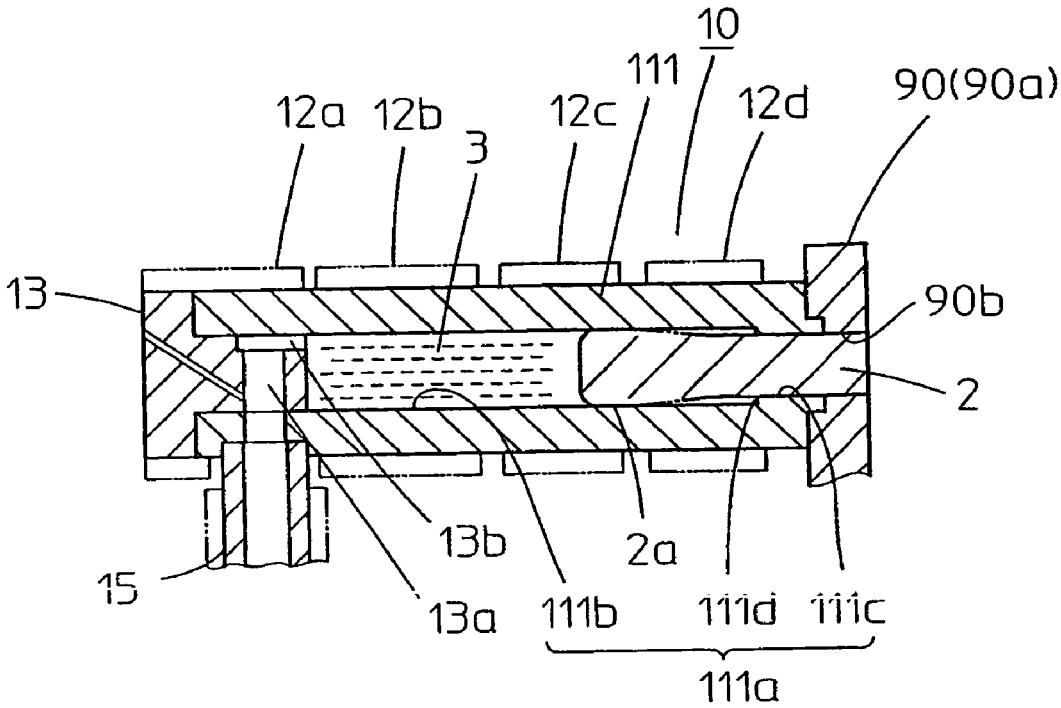
FIG. 2 is a cross-sectional view showing a first melting cylinder according to one aspect of the present invention.
Figure 3:
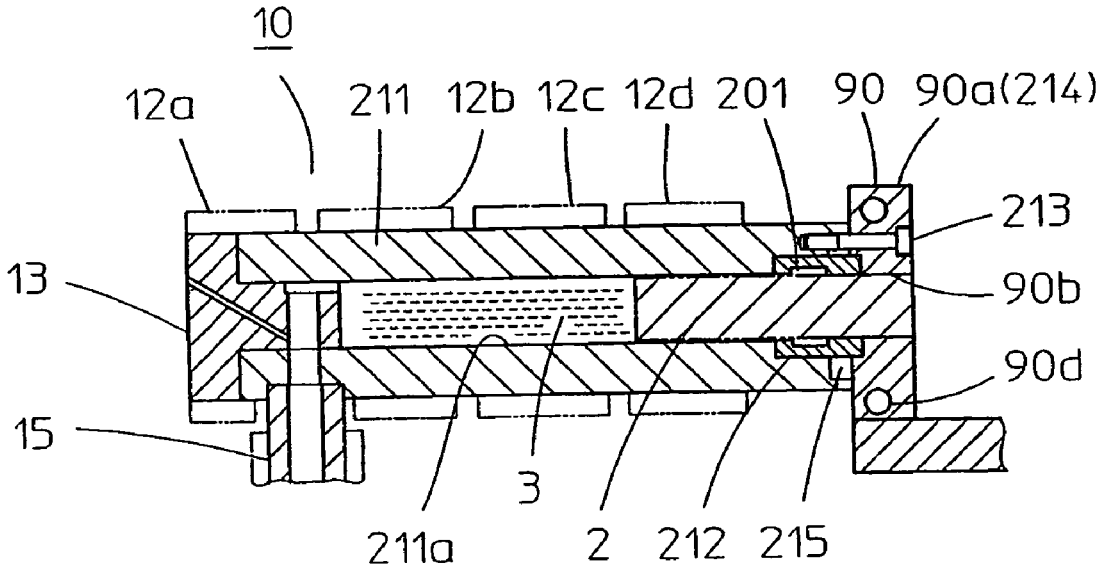
FIG. 3 is a cross-sectional view showing a second melting cylinder according to a second aspect of the present invention.
Figure 4:
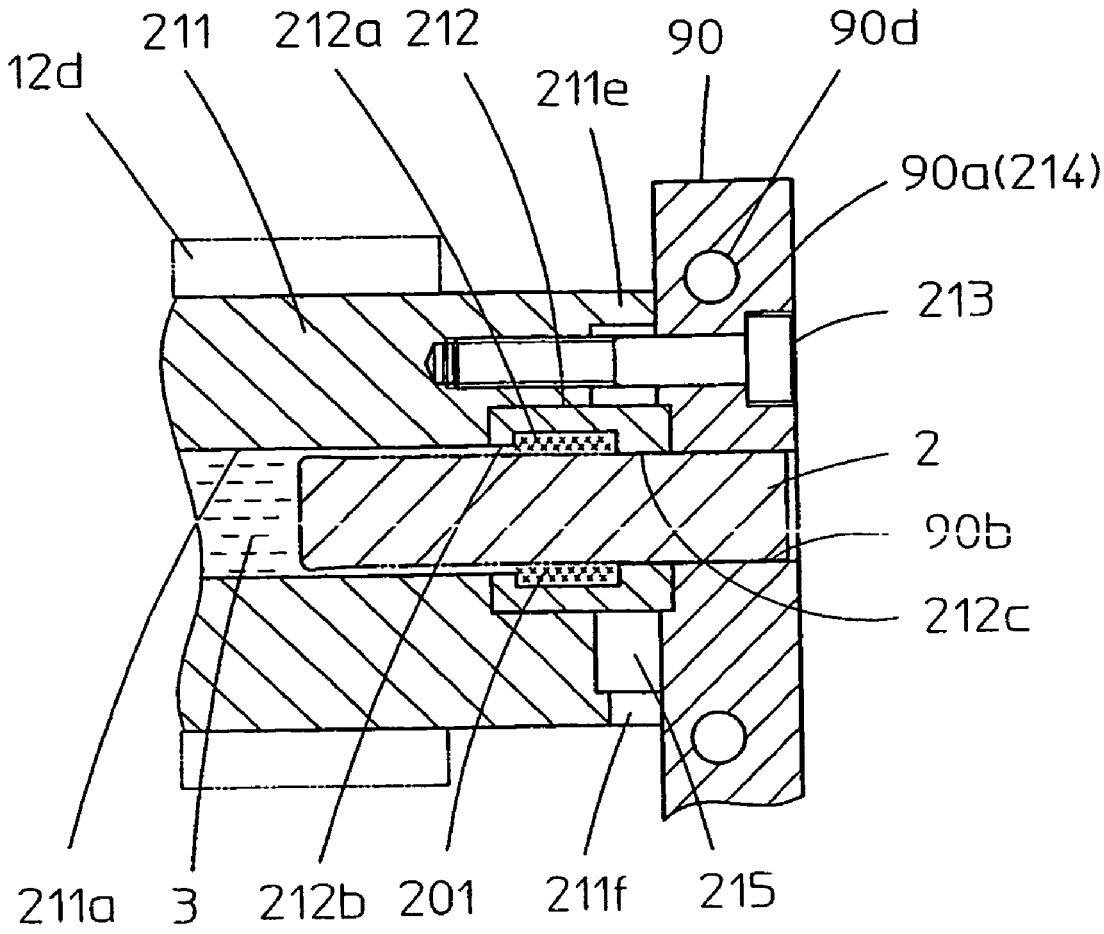
FIG. 4 is an enlarged cross-sectional view of base portion of the FIG. 3 second melting cylinder.

Next, one example embodiment of the melting device 10 which includes the characteristic features of the present invention is described in detail, below. FIG. 2 is a cross-sectional side view showing the first example embodiment of the melting cylinder 11, and FIG. 3 is a cross-sectional side view showing the second example embodiment of the melting cylinder 11. FIG. 4 is an enlarged cross-sectional view of the base portion of the FIG. 3 embodiment.

FIG. 2 depicts the first melting cylinder 111 of the first example embodiment. Most of a cylinder bore 111*a* of the cylinder 111, with the exception of the portion near the base end, is formed to have a few millimeters larger of a diameter than the billet 2, and the base end of the cylinder bore 111*a* has a slightly larger diameter than the billet 2, forming a stepped section 111*d* in between. In case the melting cylinder is used for melting magnesium alloy, the gap of a larger diameter cylinder bore 111*b* with regard to the billet 2 is formed with a clearance of about 1 mm to 2. Also, the gap of a base end side of the cylinder bore 111*c* with the billet 2, which has slightly expanded due to heat, is formed with a clearance of about 0.2 to 0.5 mm.

The position of the stepped section 111*d* is formed at an appropriate position in accordance with certain conditions, such as the inside diameter of the melting cylinder 111, the volume of molten metal 3, temperature setting of the heater bands 12*c* and 12*d*, or the gap of the larger diameter cylinder bore 111*b* with the billet 2. The inside diameter of a cylinder bore 111*c* of base end side represents a cylinder diameter which shows one of specification indexes of the injection machine.

FIG. 3 denotes a second melting cylinder 211 according to a second example embodiment of the present invention. The melting cylinder 211 is combined with its base end to the side plate 90*a* of the central frame member 90 by bolts 213 along with a cooling sleeve 212 which is described in more detail, below. According to the second example embodiment, a cooling duct 90*d* is formed at the periphery of the through hole 90*b* of the side plate 90*a*, for circulating cooling fluid. As such, the side plate 90*a* functions as a cooling member and is referred to as a cooling member 214 in the following description.

The cooling member 214 is formed apart from the side plate 90*a*, and is arranged anywhere between melting cylinder 211 and the side plate 90*a*. If the billet 2 is comprised of magnesium alloy, the gap between the through hole 90*b* and the billet 2 is formed to have a clearance of about 0.2 mm to 0.5 mm when the billet 2 has thermally expanded. Owing to the gap in the through hole 90*b* and the cooling operation of side plate 90*a*, billets 2 are inserted without interfering with the through hole 90*b*, and are maintained in a non-softened state so that the billet 2 does not deform with the pressure of molten metal 3 which slightly rises during measuring.

The inside diameter of the cylinder bore 211*a* of the second melting cylinder 211 is formed a few millimeters larger than billet 2. For example, in the case where the molding metal is comprised of magnesium alloy, the gap is formed about 1 to 3 millimeters larger than the billet 2, for reasons described below. As depicted in FIG. 4, the melting cylinder 211 also has an annular protrusion 211*e* of the shape of the sleeve on the outer side of the base end, forming a space 215 in combination with the cooling sleeve 212 and the cooling member 214. The annular protrusion 211*e* forms a plurality holes or cutouts 211*f* from which heat which is confined in the space 215 is dissipated. Accordingly, the space 215 functions as a heat insulating space between the cooling member 214 and the melting cylinder 211.

The cooling sleeve 212, fixed between the base end of the melting cylinder 211 and the side plate 90*a* of a cooling member 214, is formed to be a small and substantially thin cylindrical member, so that surface contact is minimized. As illustrated in FIG. 4, the cooling sleeve 212 is fitted in a bored hole on the front surface of cooling member 214 and a bored hole on the base end of melting cylinder 211. The cooling sleeve 212 also has a temperature sensor (not depicted) to detect temperature.

As shown in FIG. 4, in a hole formed in the cooling sleeve 212, an annular groove 212*a* is formed, in which molten metal 3 which has flowed backward along the periphery of the billet 2 is solidified and kept. In the case where billets 2 are comprised of magnesium alloys, the annular groove 212*a* is formed to be 20 mm to 40 mm in width (preferably 30 mm), and 3 mm to 4 mm in depth with respect to the cylinder bore 211*a*. The inside diameter of a hole 212*b* of the cooling sleeve 212 at the front side of the annular groove 212*a* is formed to be equal to that of cylinder bore 211*a*, and the inside diameter of a hole 212*c* at the back side of the annular groove 212*a* is formed to be equal to that of the through hole 90*b*.

Since the annular groove 212*a* is formed in the cooling sleeve 212, which contacts the cooling member 214, the annular groove 212*a* is powerfully cooled by the cooling member 214. The operational effect of the annular groove 212*a* is described in more detail, below. The annular groove 212*a* is formed to be completely contained in the cooling sleeve 212, as shown in FIG. 4, but it may be formed to have a contact with either side of the melting cylinder 211 or the cooling member 214.

It is desired that the cooling sleeve 212 be made of a similar material to the melting cylinder 211 and/or the cooling member 214, with respect to rigidity and thermal expansion. It is also desired that the cooling sleeve be made of the material that has as good thermal conductivity as possible. This means that cooling sleeve 212 may be formed together with either the melting cylinder 211 or the cooling member 214.

Moreover, the cooling sleeve 212 has no problem in stiffness, despite being made of a small volume member, as illustrated, specifically a comparatively thin cylindrical member. That is because a circular solidified material 201, which is formed in the annular groove 212*a* as described below, prevents molten metal 3 from leaking backward beyond the circular solidified material 201 and thus suppresses high pressure.

With regard to above-described heater bands 12*a*, 12*b*, 12*c* and 12*d* of the first melting cylinder 111 and the second cylinder 211, three front side heater bands 12*a*, 12*b* and 12*c* are set to the melting temperature of the billets 2. For example, in case billet 2 is magnesium alloy, temperature of these heater bands are set to about 600° C. to 650° C. On the other hand, the temperature setting of the heater band 12*d* for the first melting cylinder 111 and that for the second cylinder 211 may vary.

The temperature setting of heater band 12*d* of the first melting cylinder 111 is appropriately controlled to about 450° C. to about 550° C., so as to suppress the softening of billet 2 which is positioned at the base end of melting cylinder 111, because magnesium alloys begins to materially soften when they are heated to about 350° C. By being heated in this manner, the billet 2 is preliminarily heated to the extent that it does not soften in the base end of the melting cylinder 111, then it is heated at high temperature in the portion from the halfway point to the front end of the cylinder 111 while advancing inside the cylinder bore 111*a*. Finally, the billet 2 melts rapidly into molten metal 3 at a temperature of 600° C. to 650° C. at the front end of the cylinder 111. According to this embodiment, the side plate 90*a* of the central frame member 90 is generally not heated, and so in some cases the plate 90*a* may be cooled by a cooling pipe similar to the cooling duct 90*d* of the second melting cylinder 211.

On the other hand, the heater band 12*d* of the second melting cylinder 211 is fixed at the position apart from the vicinity of the base end, where the cooling sleeve 212 is attached, and heating influence to the cooling sleeve 212 is suppressed as much as possible. The temperature setting of the heater band 12*d* is controlled to about 500° C. to 550° C. As such, the cooling sleeve 212 is not subjected to heating but is cooled strongly by the cooling member 214.

The temperature of cooling sleeve 212 is primarily controlled by the cooling temperature setting of the cooling member 214, and is partially controlled by the heater band 12*d*. The plumbing through which the coolant flows can be reversed around the cooling sleeve 212 and the temperature can be individually controlled. In the case of magnesium alloy moldings, the temperature of billet 2 in the cooling member 214 can be cooled down as not to exceed approximately 100° C. to 150° C., and temperature of billet 2 in the cooling sleeve 212 may be controlled to about 400° C., which is near the temperature 350° C. at which the some softening occurs.

Since the billet 2 is heated in the first melting cylinder 111 or in the second melting cylinder 211 as described above, the billet 2 melts from its front end and turns into molten metal 3. The temperature is controlled so that several shots of the injection amount are secured, while the volume of the molten metal 3 fluctuates at every point during the molding operation measuring process. A minimal amount of material is melted and secured in the melting device 10, and heat energy is efficiently reduced. The time for raising or cooling down the temperature is reduced, minimizing wasted waiting time for maintenance and inspection work. Moreover, the volume of the melting device becomes much smaller than conventional furnaces.

The backward flow of molten metal 3 through the gap between the billet 2 and the melting cylinder 11 is prevented when one shot of molten metal 3 is supplied to the injection sleeve 21 from the melting cylinder 111 or 211 for measurement. Such sealing is done by the below-described method in both the first melting cylinder 111 and the second melting cylinder 211.

In the first embodiment, at the time of measuring, the front end of the softened billet 2 is enlarged diametrically slightly due to the slight rising pressure of the molten metal 3. A side surface 2*a* of the enlarged front end seals molten metal 3 by being appropriately kept into contact with the wall surface of the larger diameter cylinder bore 111*b* appropriately. This sealing is performed when the enlarged side surface 2*a* appropriately keeps contact with the wall surface of the cylinder bore 111*b*, and this sealing is realized by the appropriate gap size between them.

It is convenient that the rising pressure of the molten metal 3 is small at the time of measuring, preventing much of the diametrical expansion of the side surface 2*a*. Eccentricity of the billet 2 with the cylinder bore 111*b* is suppressed and the gap between the base end side cylinder bore 111*c* and billet 2 becomes small and equally minimized.

The side surface 2*a* keeps appropriate contact with the cylinder bore 111*b* as a soft and uniformly enlarged seal, since such a surface 2*a* is kept in the softened state by the heating of the heater bands 12*a* to 12*d* and the cooling of the cooling member 214. The side surface 2*a* functions as a low frictional resistance seal, and prevents intrusion of air and the like, or the leakage of molten metal 3. Accordingly the dramatically enlarged side surface 2*a* according to this embodiment is referred to as an "enlarged diameter seal member."

According to this embodiment, the gap between the larger diameter cylinder bore 111*b* and the billet 2 is appropriately pre-set in accordance with the aforementioned molding condition. First melting cylinder 111 can be easily adopted for a small-sized injection molding machine with the comparatively small inside diameter of the melting cylinder 111. In other words, since the melting cylinder 111 is composed of cylinder bores 111*b* and 111*c*, it meets with cost reduction requirements which are necessary for a small-sized injection molding machine.

Such a small-sized injection molding machine does not cause the molten metal backward flow problem as much as a large-sized injection molding machines do. The diameter of the billet 2 in a large-sized injection molding machines is sufficiently thick and the peripheral length is so long that the gap through which molten metal flows backward becomes enlarged.

On the other hand, in the second embodiment, molten metal 3 is not sealed by the above-described enlarged diameter seal member, but rather is sealed by a circular solidified material seal which is the solidified matter of molten metal 3 in the annular groove 212*a* of the cooling sleeve 212. The seal of the circular solidified material seal is described below.

In the case of magnesium alloys, the billet 2 in the cooling sleeve 212*a* is controlled to be at about 400° C., which is near its softening temperature, by being powerfully cooled by cooling sleeve 212. In this condition, when the injection apparatus 1 first commences its preparatory injection molding operation, the billet 2 advances at a slow speed, as is described below. The molten metal 3, which has already melted at the front end of the melting cylinder 211, flows backward along the billet 2, filling up the annular groove 212*a*, and changing into solidified matter. This solidified matter, as the circular solidified material 201, has includes the below-listed characteristics.

Since the circular solidified material 201 is the solidified material of molten metal 3 that follows the shape of the space between the annular groove 212*a* and the billet 2, it fills the periphery space of the billet 2 with no gaps even if there exists a slight eccentricity of the billet 2 with the melting cylinder 211. Since much of the circular solidified material 201 is fitted in the annular groove 212*a* in the solidified state, the circular solidified material 201 neither advances with the billet 2 nor breaks down, due to the pressure of molten metal at the time of measuring process. Consequently, the circular solidified material 201 does not move backwards beyond annular groove 212*a*.

Since the peripheral surface of billet 2 is rapidly heated until the measuring process by the molten metal 3, the surface of the circular solidified material 201 which comes into contact with the billet 2 is kept in an appropriately softened state. The molten metal 3 is the material filled in the gap around the periphery of the billet 2 at the time of measuring process, while the billet 2 advances. The circular solidified material 201 is not strongly adhered to the billet 2 since the solidified material 201 is a solidified material which is turned rapidly when hot molten metal 3 touches the comparatively low temperature of billet 2.

In addition, the gap between the inside diameter of the cylinder bore 211*a* of the melting cylinder 211 and the outside diameter of the billet 2 is formed to be a few millimeters so that the softened front end of the billet 2, which is enlarged slightly in diameter while advancing, does not interfere with the cylinder bore 211*a*. Molten metal 3 enters backwards behind the enlarged end of billet without being blocked, avoiding the existence of the space into which the molten metal does not enter, and suppressing the fluctuation of the amount measured by the billet 2. This problem is easily understood by contemplating the opposite problem, in which the enlarged front end of the billet 2 repeats its growth and breakage, and repeats the contact or separation from the cylinder bore 211*a*. In this opposite problem, the pushing area that functions as a piston fluctuates.

When measuring, the circular solidified material 201 fully and stably seals the gap between the billet 2 and the melting cylinder 211 when billet 2 advances and pushes out molten metal 3. The circular solidified material 201 naturally does not allow air and the like to intrude into the gap between the billet 2 and the melting cylinder 211, and also prevents backward flow of molten metal 3, reducing the functional resistance of movement of the billet 2. The sealing action of the circular solidified material 201 effectively utilizes the characteristics of light metal material, especially that of magnesium alloy. Specifically, the sealing action relies on the property of rapid phase changes from solid to fluid states because of the high coefficient of thermal conductivity, small thermal capacity, and small latent heat.

The above-described circular solidified material 201 securely seals molten metal 3. Therefore the type of melting cylinder 211 can be adopted in a large-sized injection molding machine which uses thicker diameter billet rather than a small-sized injection molding machine.

The characteristic embodiments of the other components that relate to melting cylinder 11 according to the present invention are described. In the following description, melting cylinder 11 describes either of the first melting cylinder 111 or the second melting cylinder 211, where not specified.

The embodiment depicted in FIG. 1 describes the layout position of the connecting passage 13*b*, which is formed in the end plug 13 situated on the front end of the melting cylinder 11, and further describes the installation posture of the melting cylinder 11. The connecting passage 13*b* is formed as a space between the cylinder bore 11*a* and a upper cutout of a plug portion of the end plug 13 so as to be opened at the upper portion of the cylinder bore 11*a*. In this case, this cutout is formed by removing the upper part horizontally so as to make a D-shaped cross-section, or by slotting a rectangular groove, such as a keyway, for example.

The melting device 10 that contains the melting cylinder 11 is arranged in the inclined posture with approximately 3 degrees of elevation relative to the front side. With this arrangement of the connecting passage 13*b*, when the preparatory injection molding operation commences, air or inert gas that has been trapped inside the melting cylinder 11 is substantially purged, since air and gas easily gather in the upper part. The measuring is accurate since the problem in which molten metal 3 unexpectedly overflows into the injection sleeve 21, excluding time of measuring process, is prevented by the arrangement of the connecting passage 13*b* and the inclined posture of the melting cylinder 11. In this case it is still better that the whole injection molding machine including the injection sleeve 21 and the mold clamping device 30 as well as the melting cylinder 11 is arranged in the inclined posture with its rear side low.

Figure 5:
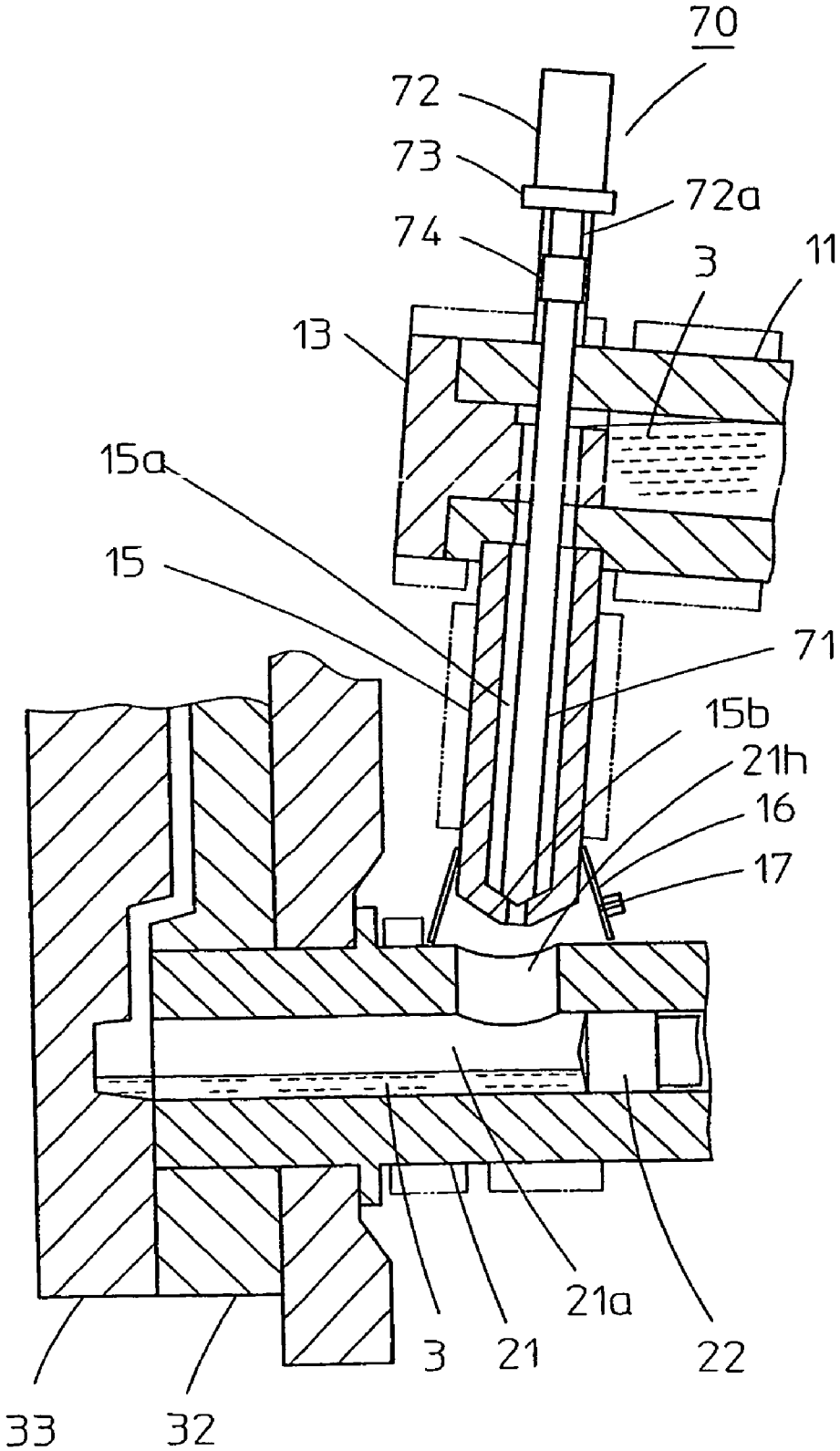
FIG. 5 is an enlarged cross-sectional view showing structure of a opening and shutting device equipped in a molten metal feeding member according to one arrangement of the present invention.

In such an embodiment, it is still better that the molten metal feeding member 15 comprises an opening and shutting device 70, as depicted in FIG. 5, which is an enlarged cross-sectional view showing the structure of the molten metal feeding member 15 and its surrounding area. In this drawing, the opening and shutting device 70 includes a valve seat 15*b* which is formed on a bottom of the material supplying hole 15*a*, a valve rod 71 which opens and shuts the material supplying hole 15*a* by touching or separating from the valve seat 15*b*, and a valve rod driving device 72 such as a fluid cylinder which drives the valve rod 71 up and down.

Between the valve rod 71 and the material supplying hole 15*a*, a gap exists which becomes a flow channel of molten metal 3. The fluid cylinder 72 is fixed on a bracket 73, and the upper end of the valve rod 71 is connected to a piston rod 72*a* of the fluid cylinder 72 by a coupling 74. The opening and shutting device 70 of the above-described structure prevents the molten metal 3 from unexpectedly dropping, except for the time of measuring, by opening the material supplying hole 15*a* only at the measuring time, since the molten metal 3 can adhere to the side wall of the material supplying hole 15*a*.

Since the material supplying hole 15*a* opens and closes near its bottom end, there is no side wall of the material supplying hole 15*a* in which molten metal 3 may adhere and sometimes drop. As such, the opening and shutting device 70 assures accurate measuring. In case this type of opening and shutting device 70 is provided, the pouring hole 17 is furnished on a cover 16 so that the valve rod 71 in material supplying hole 15*a* does not cool down.

In case this type of opening and shutting device 70 is provided, the measuring is performed under such conditions that molten metal is filled in the gap between the valve rod 71 and the material supplying hole 15*a*. The start time and end time for extruding or supplying molten metal 3 by billet 2 is controlled to coincide with the opening and shutting operation time of the material supplying hole 15*a*, which determines the start and end of the measuring operation, so that measuring is more accurately controlled.

Because no temperature fall occurs at the material supplying hole 15*a* and the valve rod 71, and since adhesion of molten metal 3 to those side wall is avoided, the material supplying hole 15*a* is filled with the molten metal. Moreover, the melting efficiency of molten metal 3 in the melting cylinder 11 is improved. The temperature fall of molten metal 3 is avoided, whereas the temperature fall occurs when molten metal 3 which faces to the connecting passage 13*b* touches inert gas. The preceding compression of the billet 2 in the melting cylinder 11 becomes possible, making melting easier.

Figure 6:
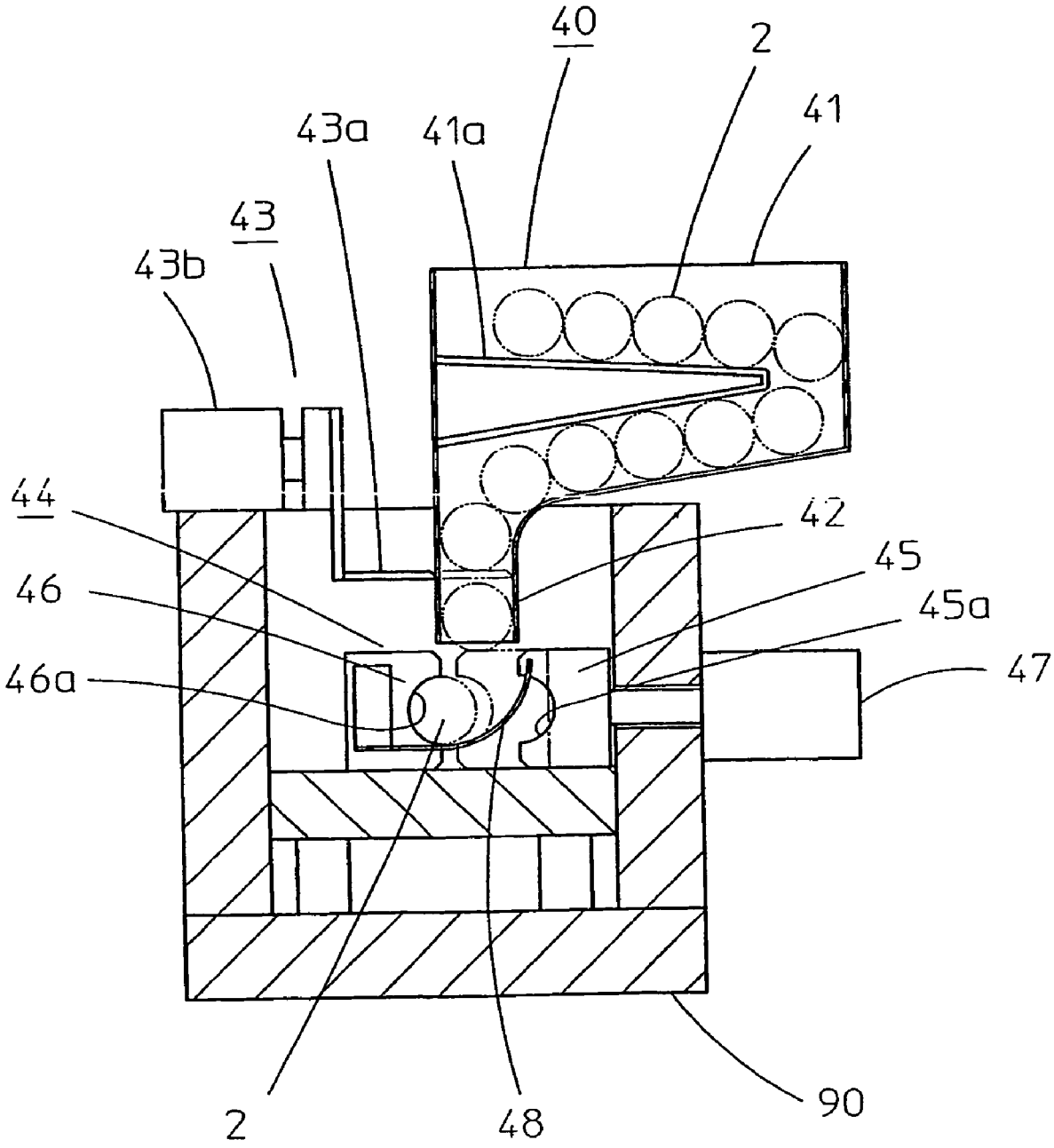
FIG. 6 is a cross-sectional view, taken along line X—X of FIG. 1, showing a billet supplying device of an injection apparatus in a cold chamber die casting molding machine according to one arrangement of the present invention.

A billet supplying device 40 is depicted in FIG. 6, which is a cross-sectional view showing the billet supplying device, taken along line X—X at the central frame member 90 from FIG. 1. This device includes a hopper 41 for holding a plurality of billets 2 loaded in a lined up state, a chute 42 for causing the billet to drop sequentially in the aligned state, a shutter device 43 for temporarily catching the billet and allowing the billets to drop one by one, and a holder 44 for concentrically holding the billet with an axial center of the melting cylinder 11.

Inside the hopper 41, a dividing plate 41*a* forming a reflex guide passage is arranged so that the billets 2 drop without accumulating. The shutter device 43 constitutes two stage shutter of an upper stage shutter and a lower stage shutter, namely a shutter plate 43*a* and a holding member 45, where the holding member 45 is a moving side of the holder 44. The shutter device 43 allows billets 2 to drop one by one by alternate opening and shutting operation of the shutter plate 43*a* and the holding member 45. Fluid cylinder 43*b*, which is an air cylinder, for example, is for moving the shutter plate 43*a* forward and backward.

The holder 44 includes one set of the holding member 45 and a holding member 46, a fluid cylinder 47 such as an air cylinder, and a guide member 48 provided below the chute 42. In guide member 48, the holding members 45 and 46 hold the billet 2 by gripping from both sides with a minuscule gap remaining, the fluid cylinder 47 opens or closes the one side holding member 45, and the guide member 48 receives the billet 2 on a curved guide surface and leads it to the holding member 46 side. On the opposing sides of the holding members 45 and the holding members 46, substantially semicircular arc-shaped indents 45*a* and 46*a*, which have a diameter slightly larger than the outside diameter of the billets, are formed in such a manner that the centers of these indents 45*a* and 46*a* are aligned with the center of the cylinder bore 11*a* when the holding member 45 is closed.

The billet 2 supplied from the hopper 41 is held concentrically by the holder 44 with the center of the cylinder bore 11*a*. Such a billet supplying device 40 holds the billet 2 in the aligned state and makes the billet 2 fall, one by one. The present invention, however, is not limited to the above-described embodiment, and contemplates any configuration which performs the above-described functions. Incidentally, billet 2 may be heated preliminary outboard at low temperature for dehumidifying its surface.

The billet inserting device 50 is now described. As shown in FIG. 1, this device includes a hydraulic cylinder 51, a piston rod 52 subjected to controlled movement backward and forward by the hydraulic cylinder 51, and a plunger 52*a* integrally formed with the end of the piston rod. The maximum movement stroke of the plunger 52*a* is set so that the length that rather exceeds the overall length of the billet 2. The plunger 52*a* advances intermittently corresponding to one shot of injection amount at every time of measuring process. The position and the speed of the plunger 52*a* is detected by a position detection device, such as a linear scale (not depicted), and is fed back to a control device (also not depicted).

The above-described billet inserting device 50 makes the plunger 52*a* move backward over greater length than the overall length of the billet 2 at the time of replenishing so as to ensure a space for billet 2. The billet inserting device 50 then inserts the billet 2 into the melting cylinder 11 while advancing the plunger 52*a*. At the time of measuring process, the billet inserting device 50 causes an intermittent advance of the plunger 52*a*, feeding a specified amount of molten metal 3 into the injection sleeve 21, where the amount fed with one advance corresponds to one shot of injection amount. This type of billet inserting device 50 is not limited to a driving device of a hydraulic cylinder, as long as it ensures the above-described operation of the plunger 52*a* and it can be a well-known electrical driving device which drives the plunger 52*a*, converting rotational movement of a servo motor to linear movement by means of a ball screw or similar mechanism.

Each component of the plunger injection device 20, combined with the above-described melting device 10, is described in detail with conjunction with the description of FIG. 1, above. These components are not limited to those described below, because they are common to a conventional injection apparatus in a cold chamber die casting molding machine.

The overall structure of the plunger injection device 20 is now described. The connecting member 64, which connects the injection sleeve 21 to the plunger driving device 60, is a cylindrical member and has a barrier wall 64*a* at the position close to the front side. The barrier wall 64*a* has a through hole into which the plunger 22 is fitted with almost no gap, and a collection pan 65 is detachably provided under the front side of the barrier wall 64*a* so as to prepare for leakage of molten metal 3. A pouring hole 64*b* for pouring inert gas is provided at an upper side of the connection member 64.

The connection member 64 having this type of structure is provided with a space 66 between the injection sleeve 21 and the barrier wall 64*a*. With this structure, even if some molten metal 3 leaked out from the base end of the injection sleeve 21, it is collected in the collection pan 65. Also, since inert gas is poured into the space 66, air remaining in the gap between the plunger 22 and the base end side sleeve bore 21*a* is purged. This type of purging ensures the preferable environment for preventing oxidization of material, especially in the case of magnesium molding. A small amount of inert gas to be supplied, because the gas is supplied into the space 66 and the small tiny gap between the injection sleeve 21 and the plunger 22.

The plunger driving device 60 is now described. For example, and as shown in FIG. 1, this device includes a hydraulic cylinder 61, where the piston rod 62 is subjected to controlled movement by the hydraulic cylinder 61, and a coupling 63 for connecting the piston rod 62 and the plunger 22. The plunger 22, which is inserted in the injection sleeve 21, is driven in the longitudinal direction forward and backward by the piston rod 62 of the hydraulic cylinder 61. The position of the plunger 22 is detected by a position detection device, such as a linear scales (not depicted), and is controlled by a controller (also not shown), to which this position is fed back. The positions to which the plunger 22 can retreat are set to the positions which are located backward from the material supply mouth 21*h*, and its maximum stroke is, in advance designs, set to be consistent with the maximum injection volume of the injection apparatus 1.

This type of plunger driving device 60 is not limited to a driving device of a hydraulic cylinder, and hence is possible to be a electrical driving device, where the driving device 60 drives the plunger 22 converting rotational movement of a servo motor to linear movement by means of a ball screw or similar mechanism.

The plunger 22 is provided with a head section 22*a* having a slightly thinner diameter than the inside diameter of the injection sleeve 21 and a shaft section 22*b* having a diameter slightly thinner than the head section 22*a*. The head section 22*a* also has a piston ring (not depicted) provided on its periphery.

This type of a plunger driving device 60 makes plunger 22 retreat behind the material supply mouth 21*h* at the time of measuring process, and after the measuring process is finished, plunger 22 is made to advance in accordance with the injection speed and injection amount. The driving device 60 controls the holding pressure, when necessary.

With the injection apparatus 1 according to the present invention, the injection molding operation is carried out, as described below, where practical injection molding operations are described first. Before the molding operation commences, a plurality of billets 2 are pre-supplied into the melting cylinder 11, and molten metal 3 equivalent to several shots of injection amount is secured in the forward side of the melting cylinder 11.

In this state, the measuring operation is carried out. The plunger 22 retreats beyond the material supply mouth 21*h*, and then plunger 52 makes billet 2 advance at the specified amount. In case the opening and shutting device 70 is provided, the opening operation of the valve rod 71 starts simultaneously. Molten metal 3 sufficient for one shot is transferred from the melting cylinder 10 to the injection sleeve 21 through the molten metal feeding member 15. This operation is done after the molded articles that have been molded in the preceding operation are taken out, and clamping of mold half is completed.

At the time of measuring, the pressure of molten metal 3 does not become too high, since the material supplying hole 15*a* of the molten metal feeding member 15 is open. The seal of molten metal 3 is performed by the above described enlarged diameter seal member, or the circular solidified material seal. In particular, in case the opening and shutting device 70 is provided and the material supplying hole 15*a* is full of molten metal 3, opening operation of the valve rod 71 is performed at the same time. Therefore the pressure of molten metal does not become too high.

Molten metal 3 measured in the injection sleeve 21 is maintained in a molten state by the heater band 23, where inert gas prevents the oxidation of molten metal. Plunger 22 moves forward and injects molten metal for one shot into the cavity 34, as is conventional done. Conventional cooling of the molded articles is performed, the mold half is opened, and the molded articles are taken out. The mold half is then closed again, and then measuring starts in the above described manner. Molten metal 3 in the melting cylinder 11, which is consumed at every time of the measuring, is melted and replenished before the next measuring starts.

Every time the measuring described above is repeated, the billet 2 intermittently moves forward. When the injection of molten metal for one billet has been done, the replenishment of billet 2 is performed. This replenishing operation starts after the position detector for the plunger 52*a* detects that the plunger 52*a* has advanced more than overall length of one billet. The billet inserting device 50 makes the plunger 52*a* retreat more than overall length of the billet 2, ensuring that space exists behind the melting cylinder 11 for supplying the billet 2. The billet supplying device 40 replenishes one billet 2 to the rear of the melting cylinder 11 and then the billet inserting device 50 pushes the billet 2 into the melting cylinder 11 so that the replenishing operation completes.

The above described enlarged diameter seal member or the circular solidified material seal prevent the infiltration of air into the molten metal 3 in the melting cylinder 11 and also prevent the backward flow of molten metal 3. Since the end surface and peripheral surface of the billet 2 are finished smooth, no air enters together with the billets, so air is not intruded into the melting cylinder 11 once purge has been completed.

The preparatory steps before the above-described practical injection molding operation are now described. Inert gas is injected for purging the air in the melting cylinder 11. The billet 2, which is pre-loaded into the hopper 41, is fed to the rear of the melting cylinder 11 by the billet supplying device 40, and is inserted into the melting cylinder 11 by the billet inserting device 50. A plurality of billets 2 are inserted in succession until they fills the melting cylinder 11.

The inserted billet 2 begins to melt from its front end of the forward portion while being heated by the heater bands 12*a* to 12*d*, and is pressed forward in the melting cylinder 11. After molten metal 3 for plural shots of injection amount is finally obtained, molten metal 3 is transferred into the injection sleeve 21 while the plunger 22 retreats and the plunger 52 advances. After molten metal 3 is supplied into the injection sleeve 21, the operation corresponding to the above-described injection operation is performed, and air or inert gas mixed into the melting cylinder 11 when forming molten metal 3 first is purged. After this purge is completed, the preparatory molding operations are repeated several times, and the molding conditions are adjusted and then the preparatory operation before molding completes.

As described above, the injection apparatus in a cold chamber die casting molding machine of according to the present invention makes it possible to supply molding material in the form of billets, while adopting a conventional plunger injection device. Therefore the injection apparatus according to the present invention facilitates the handling of the material and realizes the efficient melting and measuring of molding material, while succeeding the characteristics of the injection by the cold chamber die casting molding machine and making the furnace of melting device unnecessary. Moreover, the injection apparatus of this invention facilitates its handling by simplifying of itself, making maintenance work easy.

The invention has been described with particular illustrative embodiments. It is to be understood that the invention is not limited to the above-described embodiments and that various changes and modifications may be made by those of ordinary skill in the art without departing from the spirit and scope of the invention.

The invention claimed is:

1. An injection apparatus in a cold chamber die casting molding machine configured to supply molten metal of a light metal material into a material supply mouth of an injection sleeve, the injection sleeve having a plunger injection device configured to inject the molten metal using an inserting plunger, the injection apparatus comprising:

a melting device configured to melt the light metal material, the melting device comprising:

a billet supplying device configured to replenish the molten metal using a plurality of cylindrical rod-shaped billets of the light metal material, a billet inserting device disposed adjacent to the billet supplying device, the billet inserting device configured to move each billet forward with the inserting plunger and/or to retreat the inserting plunger a distance which exceeds an overall length of each billet, a melting cylinder situated adjacent to the billet supplying device obverse to the billet inserting device, the melting cylinder including a cylinder bore having an inside diameter which does not allow most of the cylinder bore to come into contact with a front end of each billet, the melting cylinder configured to accommodate the plurality of billets moved forward by the inserting plunger and to melt each billet from the front end of said billet to produce several shots of molten metal, a cooling member disposed between the billet supplying device and the melting cylinder, the cooling member having a through hole and a cooling duct the cooling duct configured to circulate cooling liquid around the through hole, the cooling member configured to cool the billets, and a cooling sleeve disposed between the cooling member and the melting cylinder, the cooling sleeve having an annular groove with a diameter larger than a diameter of the through hole, the annular groove configured to cool the molten metal and to form an annular seal of solidified molten material on a periphery of the billets; and a molten metal feeding member configured to pour molten metal from the melting device to the plunger injection device, the molten metal feeding member including a material supplying hole configured to pour the molten metal from a distal end of the cylinder bore of the melting cylinder to the material supply mouth, wherein the melting device is configured to meter the molten metal by pushing each billet with the inserting plunger and supplying one shot of the molten metal into the injection sleeve after the plunger injection device makes the inserting plunger retreat for replenishing.

* * * * *

UNITED STATES PATENT AND TRADEMARK OFFICE

CERTIFICATE OF CORRECTION

PATENT NO. : 7,137,435 B2
APPLICATION NO. : 10/535478
DATED : November 21, 2006
INVENTOR(S) : Misao Fujikawa It is certified that error appears in the above-identified patent and that said Letters Patent is hereby corrected as shown below:

IN THE CLAIMS:

Colum 18, line 66, there should be a --,-- after "duct".

Signed and Sealed this

Second Day of October, 2007

JON W. DUDAS
*Director of the United States Patent and Trademark Office*